US010426239B2

(12) United States Patent
Yang et al.

(10) Patent No.: US 10,426,239 B2
(45) Date of Patent: Oct. 1, 2019

(54) RECEIVING DEVICE

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Xin Yang, Shenzhen (CN); Chia-Jui Hu, New Taipei (TW); Hao-Yuan Huang, New Taipei (TW); Yen-Yu Chen, New Taipei (TW); Chun-Kai Peng, New Taipei (TW)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 176 days.

(21) Appl. No.: 15/605,975

(22) Filed: May 26, 2017

(65) Prior Publication Data

US 2017/0340079 A1 Nov. 30, 2017

(30) Foreign Application Priority Data

May 28, 2016 (CN) ..... 2016 1 0364044

(51) Int. Cl.
*A45C 11/34* (2006.01)
*B43K 23/00* (2006.01)
(Continued)

(52) U.S. Cl.
CPC ..... *A45C 11/34* (2013.01); *A45C 13/001* (2013.01); *A45C 13/02* (2013.01);
(Continued)

(58) Field of Classification Search
CPC ..... A45C 11/34; A45C 11/36; A45C 11/38; A45C 13/00; A45C 13/001; A45C 13/002; A45C 2013/025; A24F 19/0085; A24F 19/0064; G06F 2200/1632; G06F 3/03545
USPC ..... 220/263, 264, 502, 371, 446, 443, 214, 220/1.7, 575, 252, 827; 206/371, 224; 178/19.01, 19.02, 19.03, 19.04, 19.06; 281/30; 402/4, 80 R; 345/179;
(Continued)

(56) References Cited

U.S. PATENT DOCUMENTS 271,817 A * 2/1883 Dumke ..... A45C 11/34 206/214
599,130 A * 2/1898 Hudert ..... A45C 11/34 206/214

(Continued)

*Primary Examiner* — J. Gregory Pickett
*Assistant Examiner* — Gideon R Weinerth
(74) *Attorney, Agent, or Firm* — ScienBiziP, P.C.

(57) ABSTRACT

A receiving device includes a casing, a guiding member, a rotation member, a key, and a pushrod. The casing includes a baseboard, a first side plate, a second side plate, and a receiving member. The guiding member is received in the receiving member and defines a receiving groove. The rotation member rotatably covers the receiving groove and defines a bump element. The bump element is mounted on the first side plate through a first spring. The key is movably arranged in the casing. The pushrod includes a first end, a second end, and a spindle. The key is driven by an external force to drive the pushrod to rotate about the spindle, and the pushrod drives the rotation member to rotate until the receiving groove is no longer covered, thus the receiving groove is opened.

9 Claims, 6 Drawing Sheets

(51) Int. Cl.

| | |
|---|---|
| ***B65D 85/20*** | (2006.01) |
| ***A45C 13/02*** | (2006.01) |
| ***A45C 13/00*** | (2006.01) |
| *A45C 11/00* | (2006.01) |

(52) U.S. Cl.
CPC ... *A45C 2011/002* (2013.01); *A45C 2011/003* (2013.01); *A45C 2013/025* (2013.01)

(58) Field of Classification Search
USPC ..... 361/679.55; 131/231, 191, 174, 235.1, 131/242, 242.5; 406/62, 186; 312/307; 24/10 R, 11 CT; 211/69.1, 69.5; D19/83, D19/135; D14/411, 432
See application file for complete search history.

(56) References Cited

U.S. PATENT DOCUMENTS 613,063 A * 10/1898 Fischer ..... A45C 11/34 206/214
632,167 A * 8/1899 Biesmeyer ..... A45C 11/34 206/214
655,639 A * 8/1900 Schneider ..... A45C 11/34 206/214
1,029,321 A * 6/1912 Schaffer ..... B65D 43/00 220/252
1,169,553 A * 1/1916 MacMillan ..... B65G 51/06 406/186
1,533,682 A * 4/1925 Woywot ..... A24F 19/00 131/231
1,838,090 A * 12/1931 Caldwell ..... A24F 19/14 131/237
2,559,361 A * 7/1951 Langel ..... A24F 19/08 220/263
2,573,776 A * 11/1951 Dwight ..... A24F 19/14 131/237
2,732,968 A * 1/1956 Vivolo ..... A24F 19/08 131/242
2,779,341 A * 1/1957 Smillie ..... A24F 19/14 131/237
2,920,787 A * 1/1960 Garwood ..... A24F 19/0085 131/242
3,059,875 A * 10/1962 Kelley ..... B65G 51/06 406/186
4,564,078 A * 1/1986 Enokido ..... B43K 8/22 178/19.01
4,820,071 A * 4/1989 Steinfield ..... B42F 13/26 281/30
2006/0257196 A1* 11/2006 Liu ..... B43K 23/001 401/88
2011/0157100 A1* 6/2011 Hsieh ..... G06F 3/03545 345/179
2013/0070397 A1* 3/2013 Xie ..... G06F 1/1626 361/679.01
2015/0118884 A1* 4/2015 Hu ..... H04B 1/3816 439/310
2017/0340079 A1* 11/2017 Yang ..... A45C 11/34
2018/0062686 A1* 3/2018 Lucente ..... A45C 13/02
2018/0267625 A1* 9/2018 Yang ..... G06F 1/1626

* cited by examiner

RECEIVING DEVICE

CROSS-REFERENCE TO RELATED APPLICATIONS

This application claims priority to Chinese Patent Application No. 201610364044.1 filed on May 28, 2016, the contents of which are incorporated by reference herein.

FIELD

The subject matter herein generally relates to mechanical devices, and particularly to a receiving device.

BACKGROUND

Many smart electronic devices like smart phones or personal computers can be configured with a pencil, which is used for performing touching operations on a touch panel. However, cannot usually be conveniently kept on the electronic device.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
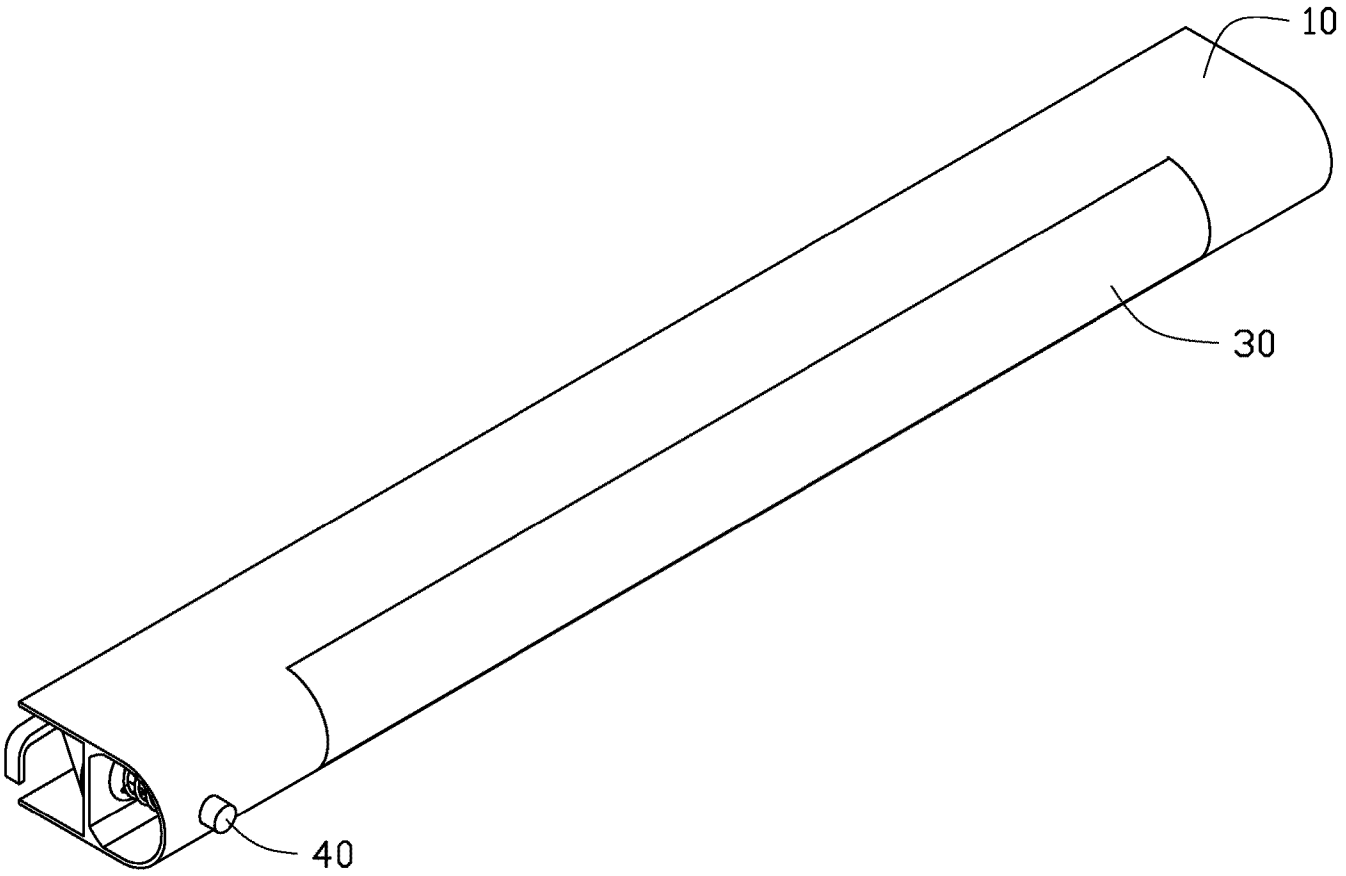
FIG. 1 is a schematic view illustrating an exemplary embodiment of a receiving device.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts have been exaggerated to better illustrate details and features of the present disclosure.

The present disclosure, including the accompanying drawings, is illustrated by way of examples and not by way of limitation. Several definitions that apply throughout this disclosure will now be presented. It should be noted that references to "an" or "one" exemplary embodiment in this disclosure are not necessarily to the same exemplary embodiment, and such references mean "at least one".

The term "comprising" means "including, but not necessarily limited to", it specifically indicates open-ended inclusion or membership in a so-described combination, group, series, and the like.

Figure 2:
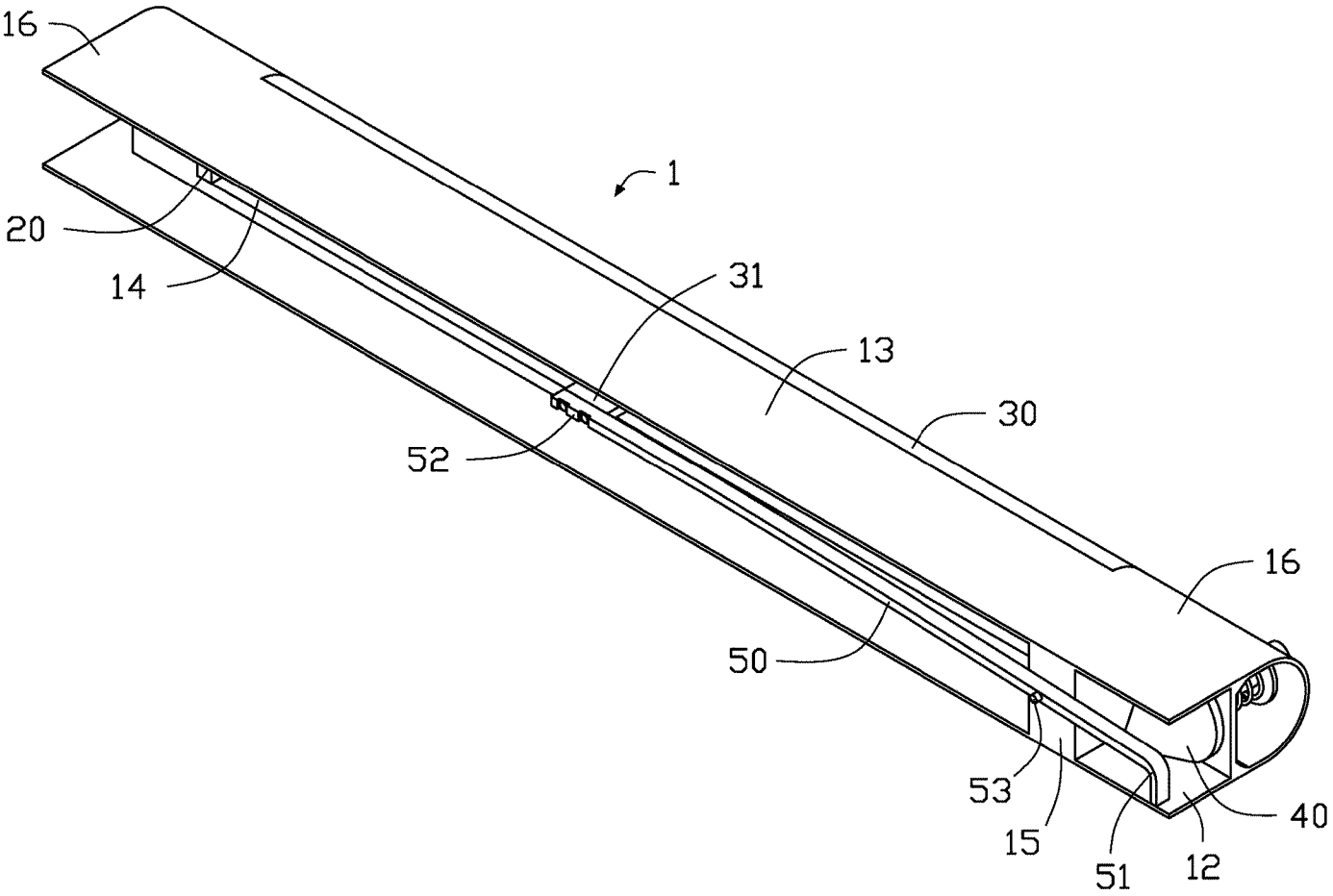
FIG. 2 is a schematic view from another angle of the receiving device in FIG. 1.

FIGS. 1-2 illustrate an exemplary embodiment of a receiving device 1. The receiving device 1 includes a casing 10, a guiding member 20, a rotation member 30, a key 40, and a pushrod 50. In at least one exemplary embodiment, the receiving device 1 is used for receiving a pencil 2. In other exemplary embodiment, the receiving device 1 can also receive other rod-shaped object. FIG. 1 illustrates only one example of the receiving device 1, other examples can include more components than as illustrated.

Figure 3:
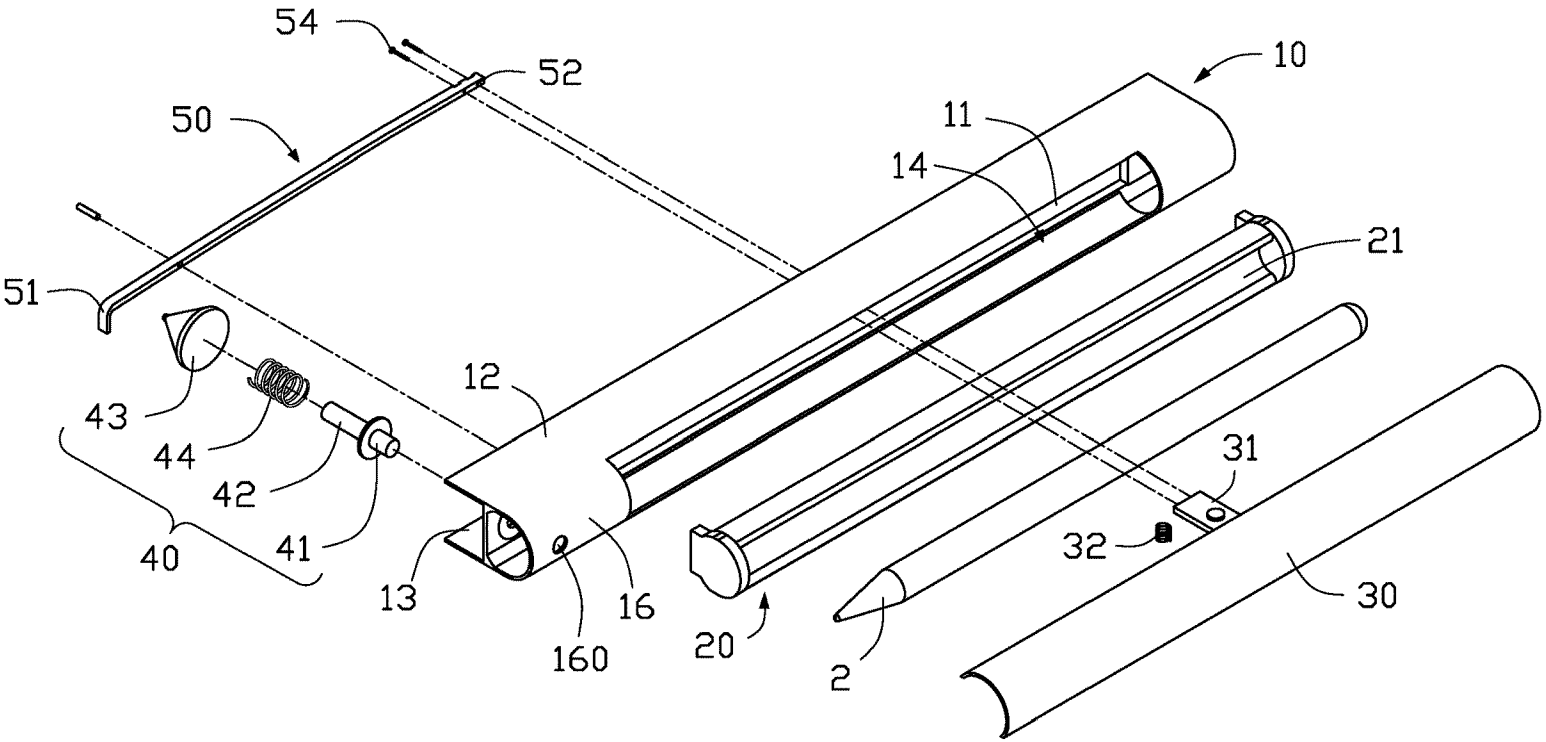
FIG. 3 is an exploded view illustrating an exemplary embodiment of the receiving device in FIG. 1.
Figure 4:
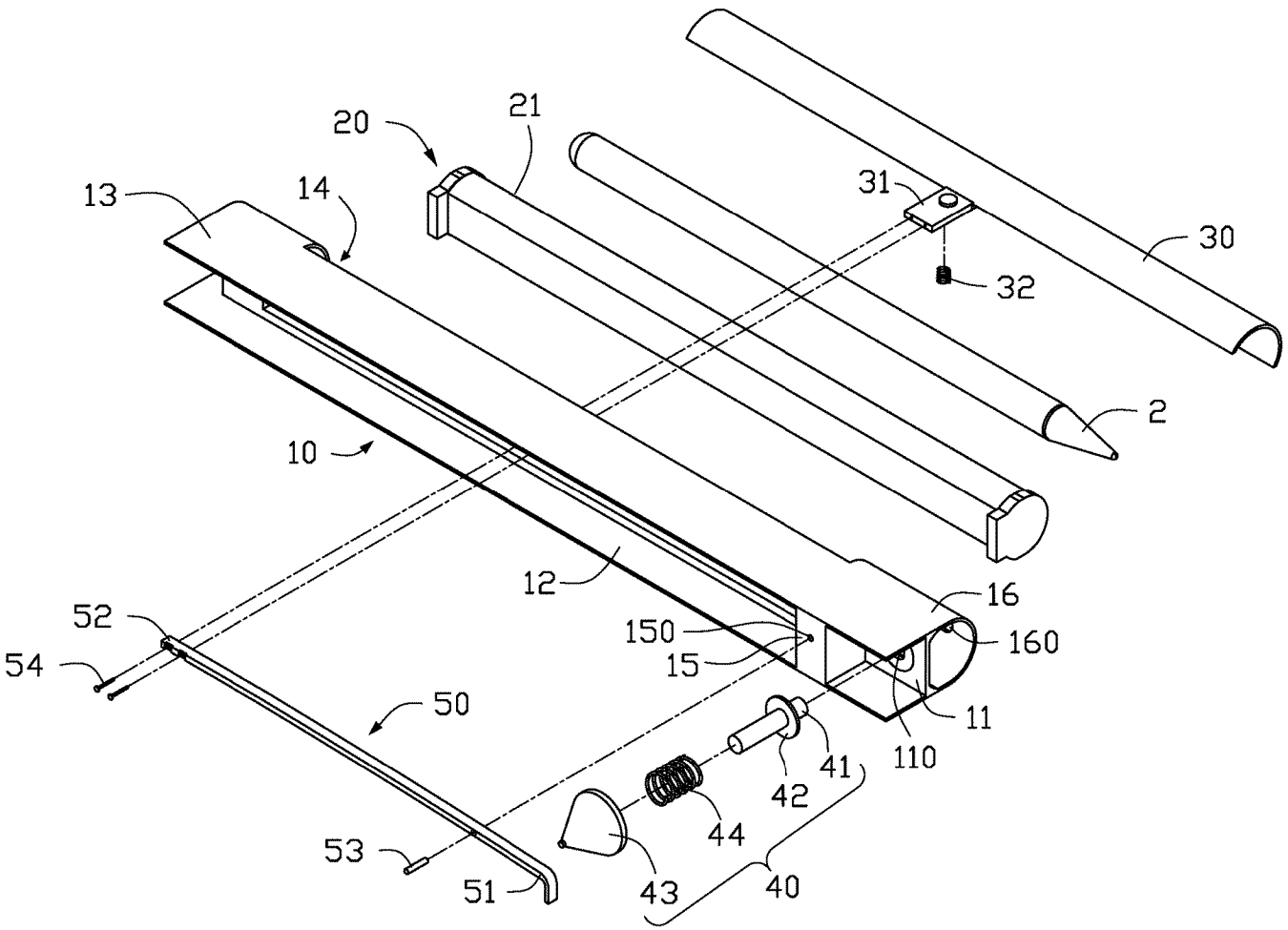
FIG. 4 is an exploded view from another angle of the receiving device in FIG. 3.

Referring to FIGS. 3-4, the casing 10 includes a baseboard 11, a first side plate 12, a second side plate 13, and a receiving member 14. The second side plate 13 faces the first side plate 12. In at least one exemplary embodiment, the receiving member 14 is formed by the first side plate 12 and the second side plate being encircled on two facing sides of the baseboard 12. The receiving member 14 is used for receiving the guiding member 20. The guiding member 20 defines a receiving groove 21, and the receiving groove 21 receives the pencil 2.

The rotation member 30 covers the guiding member 20. In at least one exemplary embodiment, a shape of the rotation member 30 matches with a shape of the receiving member 14. When the rotation member 30 covers the guiding member 20, the rotation member 30 can cover the receiving member 14 at the same time, thus the rotation member 30 can prevent the pencil 2 from dropping out of the receiving groove 21.

The rotation member 30 includes a bump element 31 and a first spring 32. The bump element 31 is mounted on the first side plate 12 through the first spring 32. One end of the first spring 32 is mounted on the bump element 31, the other end is mounted on the first side plate 12.

As illustrated in FIGS. 1-2, the key 40 is movably arranged in the casing 10, and a portion of the key 40 is exposed from the casing 10. The pushrod 50 includes a first end 51, a second end 52, and a spindle 53. The first end 51 contacts the key 40, the second end 52 is mounted on the bump element 31 through screws 54 (as shown in FIG. 3), and the spindle 53 is mounted on the casing 10.

Figure 5:
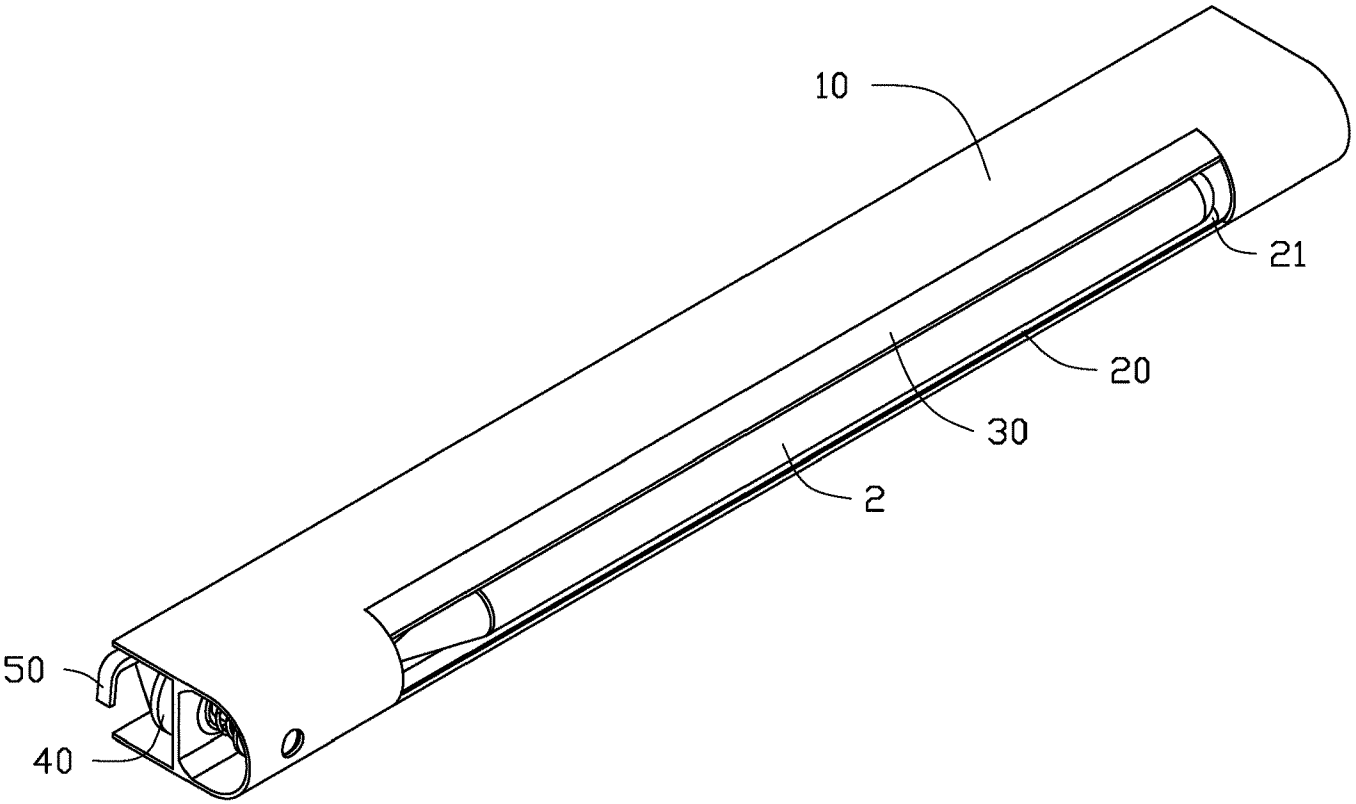
FIG. 5 is a schematic view illustrating a receiving groove of the receiving device in an open state.
Figure 6:
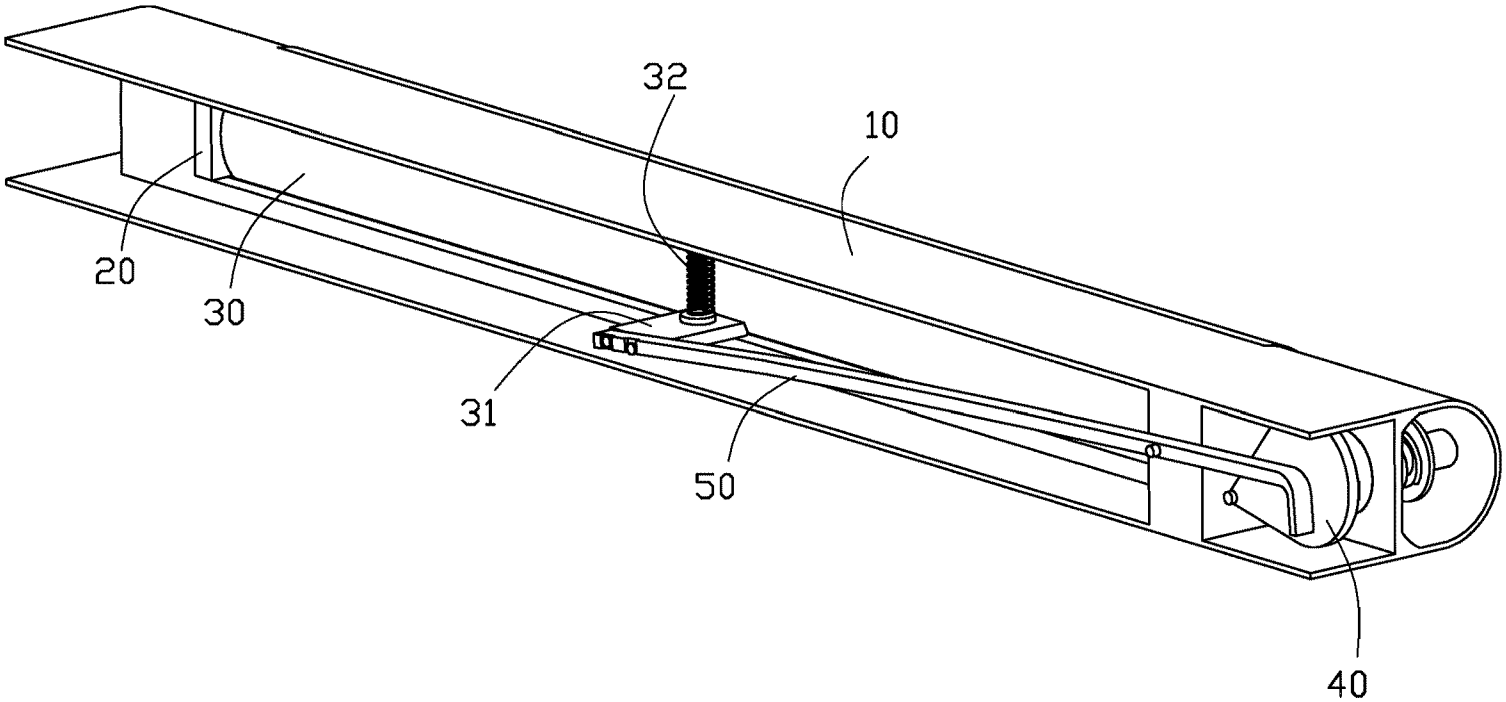
FIG. 6 is a schematic view from another angle of the receiving groove of the receiving device in the open state.

Referring to FIGS. 5-6, when a user takes the pencil 2 out of the receiving groove 21 or places the pencil 2 into the receiving groove 21, the key 40 is pressed. The key 40 drives the first end 51 of the pushrod 50 to move towards the first side plate 12, then the pushrod 50 rotates about the spindle 53. The second end of the pushrod 50 drives the bump element 31 of the rotation member 30 to move towards the second side plate 13, the bump element 31 drives the rotation member 30 to rotate beyond covering the guiding member 20, thus the receiving groove 21 is opened.

After the user takes the pencil 2 out of the receiving groove 21 or places the pencil 2 into the receiving groove 21, the key 40 is released. The bump element 31 is driven to move towards the first side plate 12 by an elastic restoring force of the first spring 32, and drives the rotation member 30 to rotate until the guiding member 20 is again covered, thus the receiving groove 21 is closed. At the same time, the bump element 31 also drives the pushrod 50 to rotate about the spindle 51 back to an initial position.

As illustrated in FIG. 3, in at least one exemplary embodiment, two ends of the guiding member 20 are arc-shaped, the rotation member 30 is a sheet structure with a curved surface which matches with the two ends of the guiding member 20, thus the rotation member 30 can be driven to rotate along the two ends of the guiding member 20.

The bump element 31 is mounted on a side of the rotation member 30, and portions of the bump element 31 coupled to the rotation member 30 are made from soft materials, thus the bump element 31 is movably arranged on the rotation member 30. When the bump element 31 is driven to move towards the first side plate 12 or the second side plate 13, the bump element 31 also moves relative to the rotation member 30, and drives the rotation member 30 to rotate.

As illustrated in FIGS. 3-4, the casing 10 further defines a fixing member 15 and two bulges 16. The fixing member 15 is mounted on the baseboard 11. The bulges 16 are respectively arranged on two ends of the casing 10. The fixing member 15 defines a hole 150, and a portion of the spindle 53 is received in the hole 150. The bulge 16 is a sheet structure with a curved surface which aligns with the rotation member 30. The two bulges 16, the first side plate 12, and the second side plate 13 are integrated.

The baseboard 11 defines a first through hole 110, the first through hole 110 is arranged close to the first end 51 of the pushrod 50. The bulge 16 close to the first end 51 defines a second through hole 160. The second through hole 160 aligns with the first through hole 110.

In at least one exemplary embodiment, the key 40 is passed through the first through hole 110 and the second through hole 160. The key 40 includes a pressing member 41, a supporting member 42, a pushing member 43, and a second spring 44. The pressing member 41 is exposed out of the casing 10 from the second through hole 160, for the user to press. The supporting member 42 is coupled to the pressing member 41 and the pushing member 43. The pushing member 43 is cone-shaped, and is in contact with the first end 51 of the pushrod 50. The second spring 44 covers the supporting member 42, one end of the second spring 44 supports the supporting member 42, the other end supports the baseboard 11. In at least one exemplary embodiment, the first end 51 of the pushrod 50 is right-angled, and is in contact with the pushing member 43.

When the key 40 is pressed, the pressing member 41 and the supporting member 42 are driven to move towards the baseboard 11 to compress the second spring 44. The pushing member 43 is driven to move away from the baseboard 11, thus the pushing member 43 drives the first end 51 to move towards the first side plate 12. When the key 40 is released, the key 40 restores to the an initial position by an elastic restoring force of the second spring 44.

In at least one exemplary embodiment, the receiving device 1 can be arranged on an electronic device conveniently for taking or receiving the pencil 2. The electronic device can be a smart phone, a tablet computer, or a learning machine.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the present disclosure.

What is claimed is:

1. A receiving device comprising:

a casing comprising a baseboard, a first side plate, a second side plate, and a receiving member;

a guiding member received in the receiving member and defining a receiving groove used for receiving a rod-shaped object;

a rotation member rotatably covering the receiving groove and defining a bump element and a first spring, wherein the bump element is connected to the first side plate by the first spring;

a key movably arranged in the casing and having an exposed end protruding out from the casing; and a pushrod comprising a first end contacting the key, a second end mounted on the bump element, and a spindle mounted on the casing;

wherein when the exposed end of the key is pressed, the key drives the pushrod to rotate about the spindle, and the pushrod drives the rotation member to rotate until the receiving groove is no longer covered, thus the receiving groove is made accessible.

2. The receiving device according to claim 1, wherein the casing further defines a fixing member, the fixing member is mounted on the baseboard, the fixing member defines a hole, and a portion of the spindle is received in the hole.

3. The receiving device according to claim 1, wherein two ends of the guiding member are arc-shaped.

4. The receiving device according to claim 3, wherein the rotation member is a sheet structure with a curved surface which matches with the two ends of the guiding member, the bump element is movably arranged on the rotation member, the rotation member is driven to rotate along the two ends of the guiding member by the bump element.

5. The receiving device according to claim 4, wherein the casing further defines two bulges, the bulge is a sheet structure with a curved surface which aligns with the rotation member.

6. The receiving device according to claim 5, wherein the baseboard defines a first through hole, the first through hole is arranged close to the first end of the pushrod, the bulge close to the first end defines a second through hole, the second through hole aligns with the first through hole.

7. The receiving device according to claim 6, wherein the key passes through the first through hole and the second through hole, the key comprises a pressing member, a supporting member, a pushing member, and a second spring, the pressing member extends out of the casing from the second through hole, the supporting member is coupled to the pressing member and the pushing member, the pushing member is cone-shaped, and is in contact with the first end of the pushrod, the second spring is arranged on the supporting member, one end of the second spring abuts a flanged end of the supporting member, the other end abuts the baseboard, thereby biasing the key.

8. The receiving device according to claim 7, wherein the first end of the pushrod is right-angled, and is in contact with the pushing member.

9. The receiving device according to claim 1, wherein the receiving groove of the guiding member is used for receiving a pencil.

* * * * *